US005105799A

United States Patent [19]

Wigdahl

[11] Patent Number: 5,105,799

[45] Date of Patent: Apr. 21, 1992

[54] PORTABLE FLUID HEATER

[76] Inventor: Arthur G. Wigdahl, 110 Belle Place Rd., New Iberia, La. 70560

[21] Appl. No.: 765,253

[22] Filed: Sep. 25, 1991

[51] Int. Cl.[5] ..... A61F 7/00; F24B 9/00

[52] U.S. Cl. ..... 126/210; 126/204; 126/367; 126/360 R; 122/14; 122/95.1

[58] Field of Search ..... 126/373, 204, 208, 210, 126/367, 362, 360 R, 368; 122/95 R, 14, 15, 22, 23, 368, 13 R

[56] References Cited

U.S. PATENT DOCUMENTS

| | | | |
|---|---|---|---|
| 3,391,686 | 7/1968 | Wiswell, Jr. | 126/204 |
| 3,569,669 | 3/1971 | March | 126/204 X |
| 3,572,314 | 3/1971 | Teague, Jr. | 126/210 |
| 3,762,392 | 10/1973 | Long | 126/210 |
| 3,802,397 | 4/1974 | Wariner | 126/360 R X |
| 3,815,573 | 6/1974 | Marcus | 126/204 |
| 3,875,924 | 4/1975 | Bayles | 126/204 |
| 4,294,225 | 10/1981 | Mayo | 126/208 |
| 4,390,304 | 6/1983 | Sloan | 404/110 |
| 4,457,295 | 7/1984 | Roehr | 126/204 |
| 4,480,631 | 11/1984 | Kristensen | 126/360 R |
| 4,505,254 | 3/1985 | Wigdahl | 126/360 R X |
| 4,541,410 | 9/1985 | Jatana | 126/360 R |
| 4,552,123 | 11/1985 | Birkner et al. | 126/360 R X |
| 4,766,883 | 8/1988 | Cameron | 126/351 |
| 4,830,710 | 5/1989 | Thompson | 126/260 R |
| 4,981,112 | 1/1991 | Adams et al. | 126/360 R |

*Primary Examiner*—Larry Jones
*Attorney, Agent, or Firm*—Dowell & Dowell

[57] ABSTRACT

A portable fluid heating unit which may be used for supplying warm water to divers which includes a three stage heat exchange system wherein a fluid source, such as sea water, is initially heated as it passes through coils within the heating unit firebox and is subsequently heated in a first heat exchange chamber surrounding the firebox, after which, the fluid is heated by heat exchange with the exhaust gases from the firebox in a second heat exchange chamber. The temperature of the fluid is continuously regulated to insure that the heated fluid being conveyed to a diver is maintained at a substantially constant temperature.

12 Claims, 2 Drawing Sheets

PORTABLE FLUID HEATER

BACKGROUND OF THE INVENTION

1. Field of the Invention

This invention is generally directed to heating devices and more specifically to water heaters of the type which are utilized to supply warm water to divers working in cold water areas. The invention is directed to a portable high efficiency heat exchanger wherein the water or other fluid to be heated is initially heated while being conveyed through the firebox of the heat exchanger. The fluid is thereafter directed into a heat exchange chamber which surrounds the firebox and is indirectly heated by energy passing through the walls of the firebox. The water or other fluid is further heated in heat exchange relationship with the exhaust gases from the firebox as the fluid is conveyed through passages which define a second indirect heat exchange chamber which is in surrounding relationship with respect to the exhaust gas flue of the firebox.

The heat exchanger of the present invention is designed to provide a generally continuous source of warm water which, in a preferred embodiment, is supplied directly to a diver working in cold deep sea, lake or gulf areas and includes one or more pumps by way of which water is conveyed through the heating system.

The system of the present invention also provides for user safety by automatically regulating the fluid temperature by controlling the rate at which the fluid passes through the heat exchanger and by automatically terminating fluid supply and shutting off the heat exchanger should fluid temperature rise above a predetermined level. In some instances, fresh liquid may be mixed with the heated fluid in the event the water rises above the predetermined temperature.

2. History of the Related Art

Over the years there have been a number of innovations directed to supplying heated water to divers who work in cold waters, often at water temperatures which are extremely hazardous to the diver's safety. Further, it has been found that, by providing warm or natural body temperature water to the suits of underwater divers, the divers are able to complete tasks more proficiently.

In U.S. Pat. No. 3,391,686 to Wiswell, Jr. a wet suit heating apparatus is disclosed wherein a source of fresh water supply, such as lake, gulf or sea water, is introduced into a heat exchange element where it is heated by steam tubes. The steam is created by utilizing a small portable boiler heated by kerosene, oil or similar fuel.

In U.S. Pat. No. 3,572,314 another type of heated diving suit is disclosed wherein the source of fluid to be heated is passed through a heat exchanger in direct contact with the exterior jacket of a firebox in which a fuel nozzle is located to burn oil or other combustible fuels. Once the fluid has been heated it passes through appropriate valves to the diving suit.

Another type of water heating system for divers is disclosed in U.S. Pat. No. 3,762,392 to Long. The Long heater utilizes a closed circuit system for continuously maintaining the water temperature. The heated water is mixed with a suitable quantity of unheated water so as to deliver a source of constant temperature water to a diver.

Further examples of portable water or other fluid heating units are disclosed in U.S. Pat. No. 4,390,304 to Sloan and U.S. Pat. No. 4,505,254 to the inventor of the present invention. In the Sloan device, the source of fluid is drawn when necessary and passed through an unspecified heating element after which the water is mixed with fresh water to a desired temperature and then supplied to a diving suit. In applicant's prior patent, a special type of water heater is disclosed for increasing the heat exchange efficiency of the heating system to thereby reduce fuel costs and provide for an increase in heater efficiency. More specifically, the heating unit includes a firebox having a plurality of exhaust channels extending therefrom in the form of heat exchange tubes. The tubes pass through a surrounding water jacket and thereby provide a source of heat exchange to the incoming water surrounding the firebox. In this manner, water is heated not only by contact with the sides of the firebox but is heated by contact with portions of the flue or tubes which extend upwardly through the heating unit. As with other prior art systems the heated water is conveyed through a safety control valve system before being directed to a diver's suit.

Some additional examples of prior art heaters which may be portable and which are not specifically designed for use in providing warm water to divers are disclosed in U.S. Pat. No. 4,480,631 to Kristensen, U.S. Pat. No. 4,766,883 to Cameron et al, U.S. Pat. No. 4,830,710 to Thompson, and U.S. Pat. No. 4,981,112 to Adams et al.

SUMMARY OF THE INVENTION

The present invention includes a portable fluid heating apparatus of the type which is designed to be utilized to provide a source of constant temperature water to underwater divers or for heating other fluids for different purposes. The invention includes a heat exchange unit which is mounted on a support base which also functions as the fuel tank for the heating elements associated therewith. The heat exchanger includes an enclosed firebox having at least one fuel nozzle disposed through an end wall thereof through which a combustible fuel such as oil, natural gas or the like is introduced. Surrounding the firebox is a jacket which creates a first annular heat exchange chamber. The first chamber is in fluid communication with a second heat exchanger which is in the form of an outlet channel which extends along a torturous path flue by way of which exhaust gases are vented from the firebox. Cold water or other liquid is introduced through a heat exchange coil which is mounted through the walls of the first heat exchange chamber so that the coils extend into the firebox whereby fluid being conveyed therethrough is directly heated before being conveyed to the first and second heat exchange chambers. The fluid is thereafter continuously heated by heat exchange with the exterior walls of the firebox and then by heat exchange with the exhaust gases from the firebox as the fluid passes through the torturous path heat exchange channel which surrounds or encloses the flue for the firebox. Heated fluid is then discharged from the heat exchanger through a temperature sensing control valve assembly and conveyed to a diver or other point of use.

The source of water supply for divers, use is provided by a submersible pump or pumps through flexible conduits connected to the inlet of the heating unit. Each pump may include variable controls for regulating the quantity of water supply.

It is a primary object of the present invention to provide a heat exchanger or heating unit for use with portable systems which may be used for supplying heated fluid to divers or other points of use which includes a heat exchanger having a three step heating system wherein the incoming liquid supply is initially heated by direct contact with the source of heat within a firebox, thereafter, conveyed to a surrounding fluid containment jacket where the fluid is indirectly heated through the walls of the firebox, and finally conducted in indirect heat exchange relationship with the exhaust flue gases from the firebox to thereby further increase heat exchange efficiency.

It is also an object of the present invention to provide a portable fluid heater which may be used by underwater divers or others wherein substantially all the elements of the system are mounted to a common base which base serves as the supply tank for combustible materials.

DESCRIPTION OF THE PREFERRED EMBODIMENT

Figure 1:
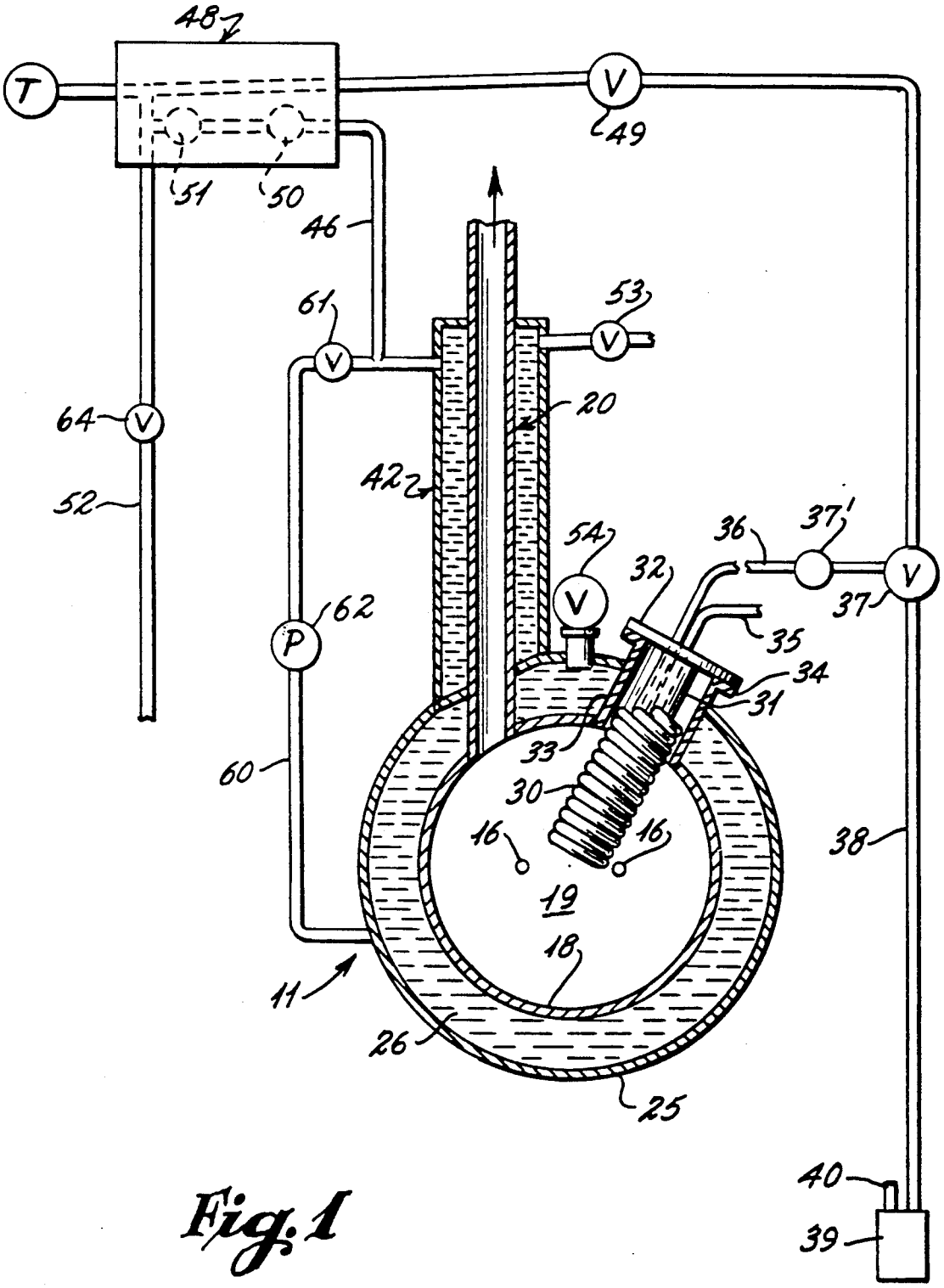
FIG. 1 is a circuit diagram and cross-sectional illustration through the firebox of the present invention showing the relationship between the intake pump, the firebox, and the temperature control valve assembly of the present invention.
Figure 2:
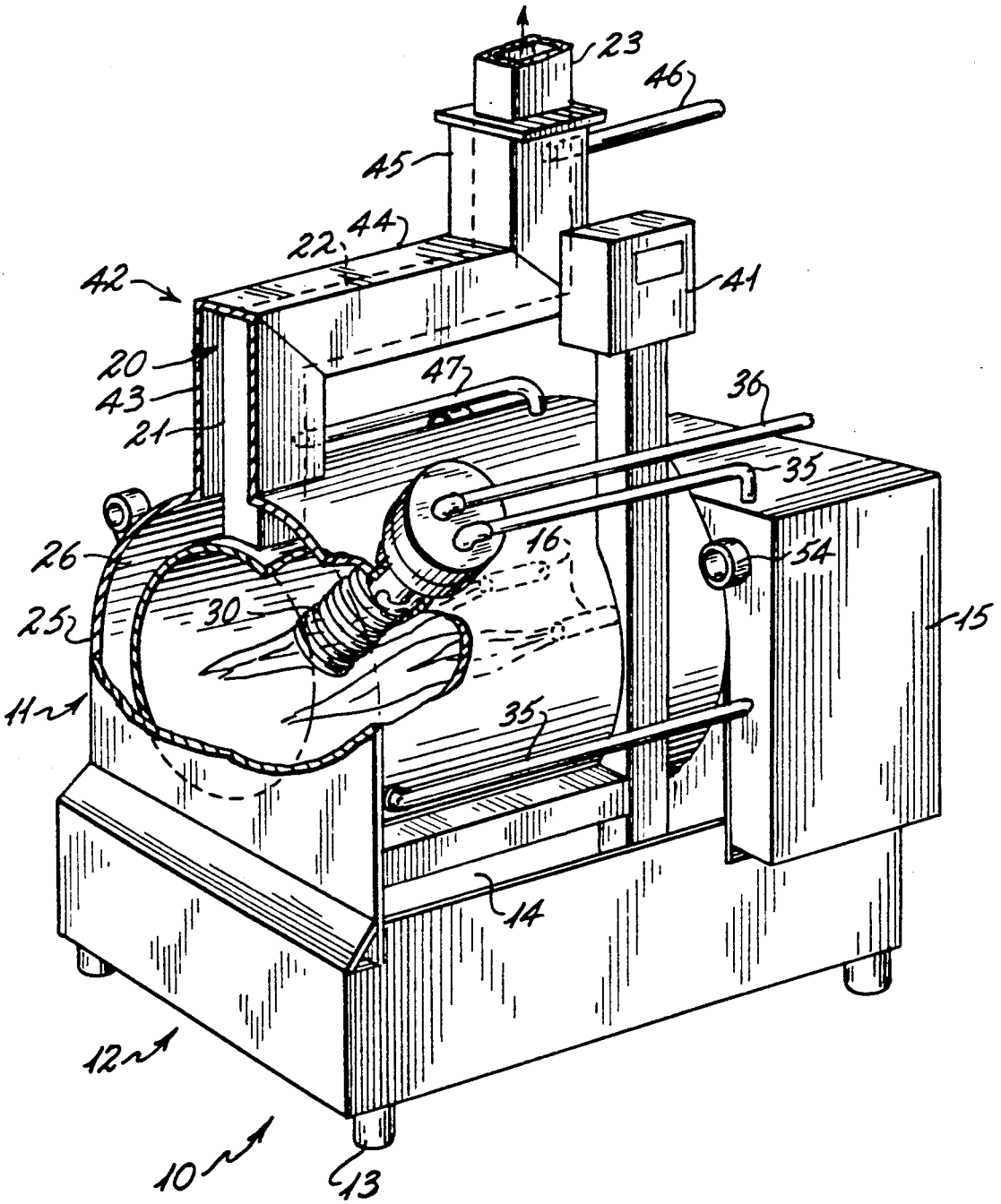
FIG. 2 is a perspective view of the portable heat exchange apparatus of the invention having portions broken away to show the relationship of the incoming cool liquid supply coils with the interior of the firebox.

With continued reference to the drawings, the portable heating unit 10 of the present invention includes a heat exchanger 11 which is mounted to a base 12. The base may be mounted on legs 13 which elevate the base sufficiently for the tines of a forklift truck or other vehicle to be extended under the base so that the heating unit may be moved from one location to another. The base 12 is fully enclosed and serves as a tank for retaining fuel which is burned in the heat exchanger 11. In most instances the fuel will be oil, however, the base may be formed as a reinforced tank in order to retain pressurized propane gas. The upper portion of the base serves as a drip pan 14 for the heat exchanger 11 and may include a fluid outlet valve (not shown) by way of which fluid may be drained therefrom.

Mounted to the base 12 is a removable cover 15 which houses the fuel burner nozzles 16 which are supplied with fuel from the fuel tank by suitable valves and pumps not shown. The controls for the burner nozzles and the igniter switches, as well, are mounted within the cover 15. The heat exchanger 11 includes an inner firebox 18 which, in the example shown, is generally cylindrical in configuration The fuel burner nozzles 16 extend through an end wall 19 of the firebox. Suitable air filters and an air inlet valve for supplying air to support combustion are provided into the firebox but are not shown in the drawing figures. The exhaust from the firebox is vented through a flue pipe 20 which includes a first vertical section 21, a horizontal section 22, and a second vertical section 23. A suitable rain cap may be mounted to the exhaust outlet. The purpose for the configuration of the exhaust duct will be discussed in greater detail hereinafter.

Surrounding the firebox 18 is a jacket 25 which is also shown as being in a generally cylindrical configuration. It should be noted that the firebox and the jacket may have different cross-sectional configurations and still be within the teachings of the present invention. The walls defining the jacket are shown as being spaced at least several inches from the firebox so as to create an annular space wherein liquid may be heated by heat convection through the walls of the firebox 18. The annular space thus forms a first fluid heat exchange chamber 26.

Fluid is introduced into the first heat exchanger chamber only after passing through a heat exchange coil 30 which is mounted so as to extend directly into the firebox 18. The coil is formed of copper or other metal tubing which is mounted around a coil support 31 carried by a closure or cap member 32. The coil extends through a cylindrical duct 33 which is mounted through the walls of the jacket 25 and through the side wall of the firebox as shown in FIG. 1. The cap 32 may be secured by conventional bolts or other means to an annular flange 34 defined along the upper portion of the duct 33. From the heat exchange coil 30, fluid is conveyed through an outlet pipe 35 which extends through the cap 32 so as to communicate with the lower forward end of annular heat exchange chamber 26. Fluid is supplied to the coil 30 by way of a conduit 36 which extends from the coil to an inlet valve 37. A strainer 37' is provided downstream of the valve 37 so as to filter impurities from the incoming fluid stream. The valve 37 is connected to a flexible conduit 38 such as a conventional hose to one or more submersible pumps 39. An appropriate electrical line 40 extends from the pump(s) to an electrical control box 41 mounted to the base assembly of the heating unit. The pump(s) may be controlled to alter the rate of fluid flow to the heating unit.

A source of cold water or other fluid is pumped from the pump(s) 39 through conduit 38 to the valve 37 upon activation of appropriate electrical controls (not shown). The fluid is supplied from valve 37 through the strainer 37' and conduit 36 into the heat exchange coil 30 wherein the water or other fluid to be heated is heated within coils 30 by contact with the flames within the firebox 18. Thereafter the initially heated fluid is conveyed through outlet pipe 35 into the annular heat exchange chamber 26 where it is further heated by contact with the side walls of the firebox.

Extending upwardly from the firebox in surrounding relationship with respect to the flue duct 20 is a second heat exchange chamber 42 which is mounted in fluid tight relationship about and spaced from the duct 20. The second heat exchange chamber includes a vertical section 43, a horizontal section 44, and a second vertical section 45. An outlet pipe 46 extends from the upper vertical section 45 through which heated fluid is discharged from the heat exchanger and into a temperature control valve assembly 48.

From the foregoing, after the fluid has been heated in the firebox and discharged for further heat exchange within the annular chamber 26, the fluid passes through conduit 47 which extends upwardly from the upper and rear portion of the first heat exchange chamber and into the vertical section 43 of the second heat exchange chamber. The fluid is further heated as it passes to the outlet pipe 46 through the torturous path created by the Z-shape configuration of the heat exchange chamber 42 thereby utilizing the exhaust gases to further increase the heat exchange efficiency. The heat exchanger of the present invention thus makes maximum use of heat exchange efficiency by initially allowing the cold incoming fluid to be directly heated in the coil assembly 30 by direct contact with the flames generated by the burner nozzle 16. Further efficiency is achieved by utilizing heat exchange through the walls of the firebox by allowing the fluid to circulate about the walls of the firebox which also simultaneously cools the firebox. The further recovery of heat from the exhaust gases by allowing the working fluid to be in heat contact with substantially the full length of the exhaust duct network provides a very efficient exchange of energy between the exhaust gases and the working fluid.

The heated water or other fluid may vary in temperature as it exits through the outlet pipe 46 and therefore controls must be provided for insuring that any heated fluid being directed to a diver or other source is first regulated to insure that the temperature is consistently the same and within a range which is safe for the intended use. In this respect, the temperature control valve assembly 48 includes a pair of aquastats which are connected with the hot fluid outlet line 46 coming from the heat exchanger. A first aquastat valve 50 is adjustable so as to regulate the temperature of the water exiting therefrom. Normally, before the heating unit is put into use, the aquastats will be set for a desired safe operating temperature range and operate to shut down the burner unit if an unsafe temperature is detected and reactivates the burner when the temperature drops to the lower level. The second aquastat valve 51 may be set at several degrees higher than the first aquastat valve and in the event of any failure of the first aquastat valve the second aquastat valve will control the burner assembly to thereby control the temperature of the fluid supply. Fluid passing through the aquastats 50 and 51 is conveyed through conduit 52 to a diver or other end use location. A bypass valve 49 is also provided adjacent the control assembly 48 by way of which the cold source of fluid supply may be directly conveyed to conduit 52 extending to the diver or other end use location.

Other safety controls and valves as well as gauges indicating proper operating temperatures may be provided with the unit. For example, a temperature gauge T is shown as being mounted to the control assembly 48. Further, a safety valve 53 is shown as being mounted to the second heat exchange chamber for purposes of releasing pressure from the unit in the event there should be an adverse pressure buildup therein. Also, a shut off float valve 54 is mounted in communication with the upper portion of the first heat exchange chamber and operates to prevent the burner nozzle from operating unless the first heat exchanger is filled with liquid.

In order to facilitate the handling and movement of the heating unit a plurality of tie down brackets 55 are welded or otherwise attached to the outer jacket 25 of the heating unit by way of which cables, chains or other types of hoisting devices may be used to lift the unit to reposition the heater as is necessary.

During the use of the heat exchanger of the present invention the heater is first conveyed to the location where a diver or other source is to be supplied with heated fluid. Generally, the fluid utilized is drawn directly from a source such as a body of water in which a diver will be working. In this respect, when sea water is used as a source of cold liquid supply, the unit should be flushed with a source of fresh water after use in order to reduce the corrosive effect of the sea water on the components of the heater.

Prior to the diver entering the body of water, the aquastats of the control assembly will be set and the pump will be lowered into the source of fluid supply. The controls of the unit are thereafter activated to energize the pump 39 to draw water into the conduits 38 and through valve 37 and strainer 37' and into conduit or pipe 36. Fluid enters the heat exchange coil 30 from pipe 35 and fills the heating chamber 26. As water or liquid continues to enter the heating unit the heating unit will fill with the water extending through the second heat exchange chamber 42. As the water fills the first heat exchange chamber, control float valve 55 will activate the burner nozzle and heating of the fluid within the heat exchanger will be initiated. Generally, the aquastats 50 and 51 will remain closed until the fluid is heated to a predetermined temperature, after which, the aquastat valves open to supply heated fluid to the diver. In some instances, during initial start-up, fluid may be circulated through a supplemental fluid line 60 which connects the outlet line 46 through a one-way valve 61 and secondary pump 62 so that the fluid within the heat exchanger is continuously circulated until it reaches a desired temperature. If fluid is being recirculated, the main valve 64 to the diver's supply line is closed.

Once heated fluid is being supplied, in the event the fluid temperature rises above a predetermined level, either the first or second aquastats will function to terminate the activation of the burners or heating nozzles thereby preventing further heat buildup within the heat exchanger. If necessary, the separate bypass valve may be opened to supply cold fluid to the diver whenever an emergency situation arises.

Due to the three step heat exchange relationship created by the configuration of the heating unit of the present invention, it is possible to very quickly and efficiently heat incoming fluid so that a continuous supply of heated fluid is made available without recirculation through the secondary line 60. Generally, by the time the cool fluid supply passes through the heating coil 30, the annular heat exchange chamber 36 and the exhaust gas heat exchange chamber 42 the temperature is elevated sufficiently to be supplied to a diver or other use location. By controlling the amount of fluid being passed through the system and the amount of fuel being burned, a substantially uniform fluid temperature is established. The aquastats will further regulate the burners to insure temperature regulation.

I claim:

1. A heating unit for supplying a source of heated water to a diver's suit from a source of cool water supply comprising, a firebox, means for heating the interior of the firebox, a jacket substantially surrounding said firebox and thereby defining a first fluid heat exchange chamber, a heat exchange coil mounted within said firebox and having a fluid inlet portion and a liquid outlet portion, said fluid outlet portion communicating with said first fluid heat exchange chamber defined by said fluid jacket and said fluid inlet portion communicating with the source of cool water supply, an exhaust flue extending from said firebox whereby gases from said firebox may be exhausted to atmosphere, a second fluid heat exchange chamber surrounding said exhaust flue and having an inlet and outlet, said inlet being in communication with said first fluid heat exchange chamber, temperature control valve means communicating with said outlet of said second heat exchange chamber, and a fluid discharge line communicating said temperature control valve means with the diver's suit

2. The heating unit of claim 1 wherein said first fluid heat exchange chamber includes upper and lower portions, said fluid outlet portion of said heat exchange coil communicating with said lower portion of said first heat exchange chamber, and said inlet of said second fluid heat exchange chamber communicating with said upper portion of said first heat exchange chamber.

3. The heating unit of claim 2 in which said second heat exchange chamber includes at least one horizontal section extending between and communicating with at least two vertical sections.

4. The heating unit of claim 1 wherein said firebox and said first fluid heat exchange chamber are mounted to a base, said base including a tank means for retaining a source of energy supply, said means for heating the interior of said firebox including at least one nozzle means, and control means for supplying said source of energy supply to said nozzle means.

5. The heating unit of claim 1 in which said source of cool water supply includes a pump means, conduit means connecting said pump means to said inlet portion of said heat exchange coil, and inlet valve means for regulating the flow through said conduit means.

6. The heating unit of claim 1 including means for circulating fluid from said outlet of said second fluid heat exchange chamber to said first liquid heat exchange chamber.

7. A heating unit for heating a cool fluid source comprising, a firebox, means for heating the interior of the firebox, a jacket substantially surrounding and in spaced relationship from said firebox defining a first fluid heat exchange chamber, a heat exchange coil mounted within said firebox and having a fluid inlet portion and a fluid outlet portion, said fluid outlet portion communicating with said first fluid heat exchange chamber defined by said jacket and said fluid inlet portion communicating with the fluid source, an exhaust flue extending from said firebox whereby gases from said firebox may be exhausted to atmosphere, a second fluid heat exchange chamber surrounding said exhaust flue and having an inlet and outlet, said inlet being in communication with said first fluid heat exchange chamber, and temperature control valve means communicating with said outlet of said second heat exchange chamber for conveying heated fluid from said heating unit wherein said heating unit is mounted on a base, said base including a plurality of feet for elevation of the base, for ease of movement of the unit.

8. The heating unit of claim 7 wherein said first fluid heat exchange chamber includes upper and lower portions, said fluid outlet portion of said heat exchange coil communicating with said lower portion of said first heat exchange chamber, and said inlet of said second fluid heat exchange chamber communicating with said upper portion of said first heat exchange chamber.

9. The heating unit of claim 8 wherein said second fluid heat exchange chamber is formed having at least two vertical sections and at least one horizontal section extending between and communicating with said two vertical sections.

10. The heating unit of claim 7 wherein said firebox and said first fluid heat exchange chamber are mounted to said base, said base including a tank means for retaining a source of energy supply, said means for heating the interior of said firebox including at least one nozzle means, and control means for supplying said source of energy supply to said nozzle means.

11. The heating unit of claim 7 in which said source of liquid supply includes a pump means, and conduit means connecting said pump means to said inlet portion of said heat exchange coil.

12. The heating unit of claim 7 including means for circulating fluid from said outlet of said second fluid heat exchange chamber to said first fluid heat exchange chamber.

* * * * *